United States Patent [19]

Lehto

[11] Patent Number: 5,009,736

[45] Date of Patent: Apr. 23, 1991

[54] METHOD OF AND AN ARRANGEMENT FOR GLUING A WEB TO A CORE IN A REELING DEVICE

[75] Inventor: Jorma Lehto, Inkeroinen, Finland

[73] Assignee: Oy Tampella AB, Tampere, Finland

[21] Appl. No.: 431,789

[22] Filed: Nov. 6, 1989

[30] Foreign Application Priority Data

Nov. 18, 1988 [FI] Finland ..... 885355

[51] Int. Cl.[5] ..... B32B 31/18

[52] U.S. Cl. ..... 156/250; 156/510; 156/522; 156/529; 242/56 R; 242/66

[58] Field of Search ..... 156/250, 159, 185, 187, 156/193, 256, 517, 529, 533, 510, 522; 242/55, 56 A, 56 B, 56 R, 58.3, 74, 66, 256

[56] References Cited

U.S. PATENT DOCUMENTS 3,841,578 10/1974 Dorfel ..... 242/66
4,422,588 12/1983 Nowisch ..... 156/517
4,456,190 6/1984 Karttunen et al. ..... 242/56 R
4,485,979 12/1984 Dropczynski ..... 242/56 R
4,552,316 11/1985 Dropczynski et al. ..... 242/56 R
4,601,441 7/1986 Oinonen et al. ..... 242/56 R
4,635,867 1/1987 Kytonen ..... 242/56 R

*Primary Examiner*—Caleb Weston
*Attorney, Agent, or Firm*—Ladas & Parry

[57] ABSTRACT

A method and an arrangement for fastening a web (4) to a core (10) in a reeling device. In the method glue is applied before the cutting off of the web between the core and the web from above the core, and the web is pressed against the core so that it adheres to it, whereby the web is cut off only after it has adhered to the core. The arrangement comprises fastening means provided with a glue spreading device mounted in the core chute in such a manner that after the core chute has been turned above the support rolls the glue spreading device is positioned between the web and the core above the core, the glue spreading device being arranged to apply glue between the core and the web before the web is cut off.

4 Claims, 2 Drawing Sheets

FIG. 2
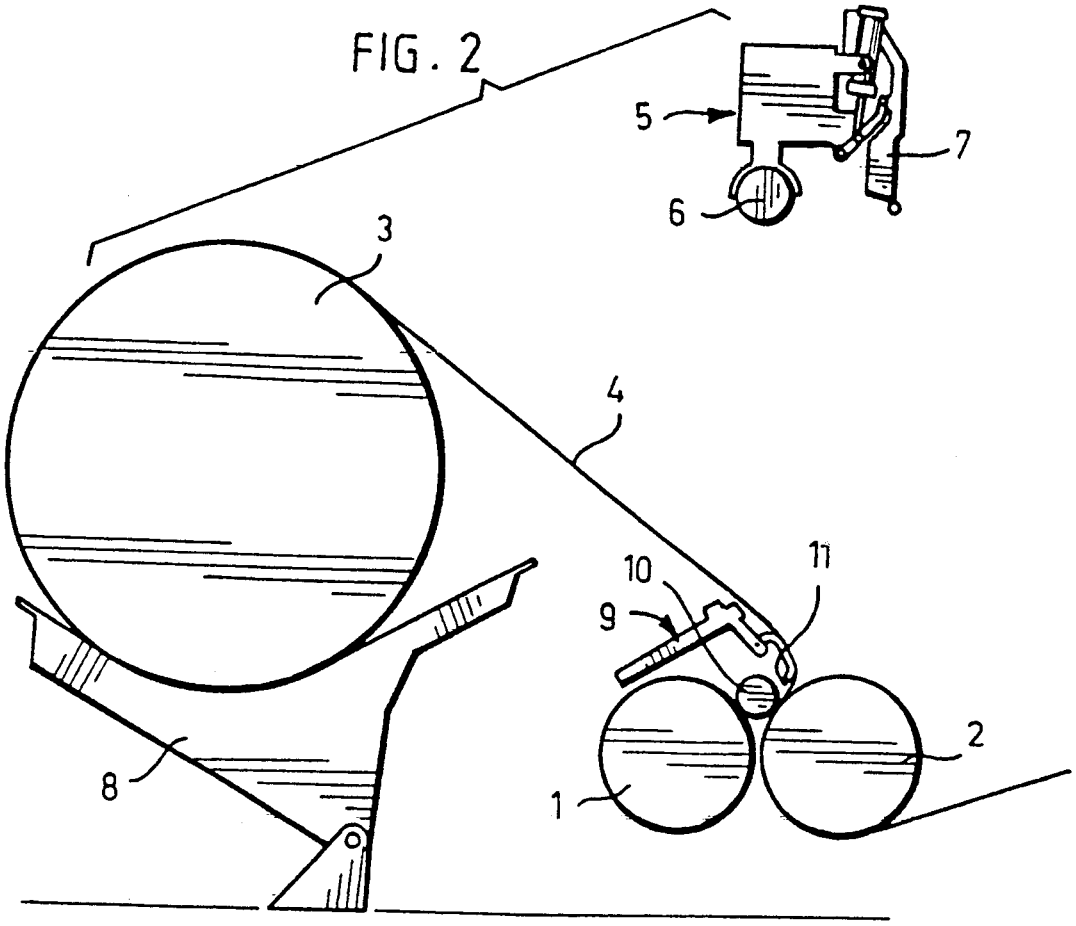
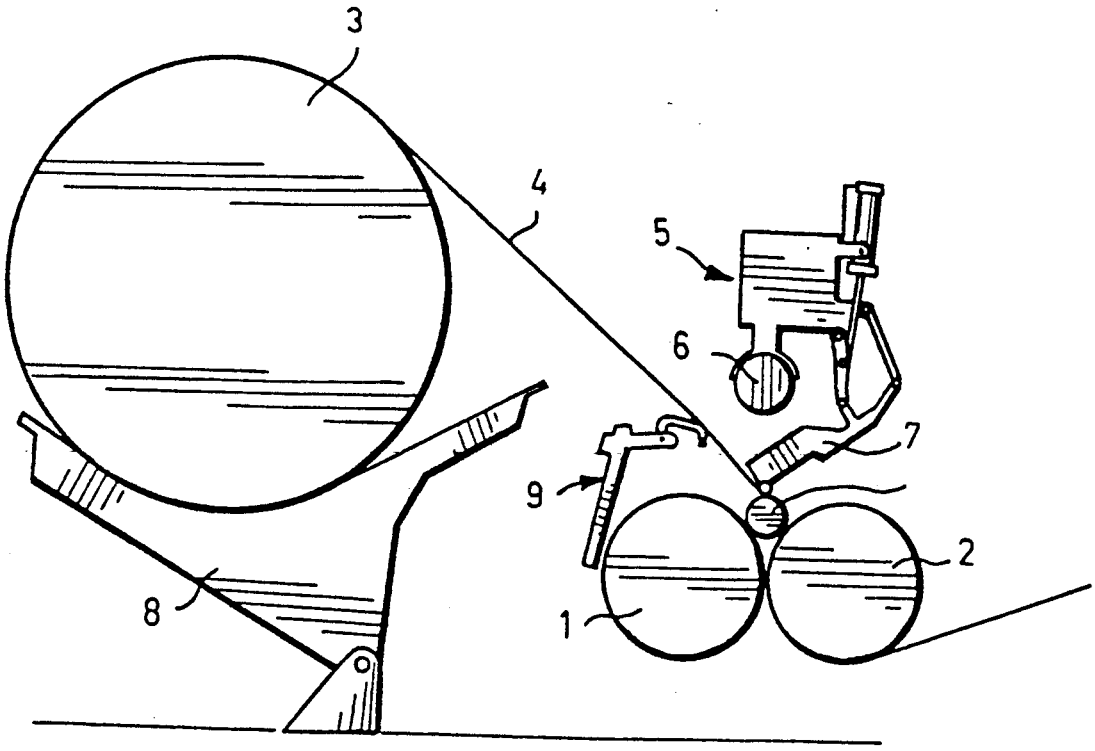
FIG. 4

METHOD OF AND AN ARRANGEMENT FOR GLUING A WEB TO A CORE IN A REELING DEVICE

The invention relates to a method of fastening a web to a core in a reeling device, comprising transferring a reeled web reel from support rolls into a lowering bucket; transferring a new core in a core chute on to the support rolls from between the lowering bucket and the support rolls before the web is cut off between the reeled web reel and a new reel to be reeled; passing the web between the reeled web reel and the support rolls above the core; cutting off the web between the core and the reeled web reel; and fastening the web to the core.

When reeling fibre webs, such as paper webs, the end of the web is fastened to a core around which the web is reeled up to a desired thickness. Thereafter the full reel is transferred away from the support rolls of the reeling device, the web is cut off, another core is placed on the support rolls, and the end of the web is glued to the core for reeling a new reel. Depending on the reeling device, these steps are carried out in different order and the end of the web is fastened to the reel in different ways.

FI Patent 69821 discloses an apparatus in which the fibre web is cut off after completed reeling, and the finished reel is transferred from the support rolls while glue is sprayed on to the web from below it. Thereafter a new core is lowered on the support rolls and the reeling of a new reel is began after the web has adhered to the core. A drawback of the apparatus of this publication is that the glue has to be sprayed on to the web in an open space and between the support rolls so that it spreads all around, the support rolls and the surroundings being contaminated by the glue spray. Furthermore, the solution of the publication requires the use of a separate retainer for preventing the web from slipping out from between the support rolls while the full reel is being transferred away from it and a new core is being placed in position.

FI Patent 71109 discloses a solution in which the end of the web is fastened to the core by spreading glue or the like to it by means of a gluing device displaceable between the support rolls. A drawback of this solution is that it requires the provision of a separate complicated gluing device which can be fitted between the rolls. This requires an installation space of determined dimensions below the support rolls, so that the height of the apparatus is increased.

FI Patent 75320, in turn, discloses a solution in which a core is displaced on to the support rolls before the web is cut off, and the web is fastened to the core from above the web after the web has been cut off. In this solution, the web has to be pressed against the core during fastening to ensure its proper adherence to the core.

The object of the present invention is to provide a method and an arrangement for fastening a web to a core reliably and simply and in such a manner that the glue spray will not spread into the surroundings. This is achieved by means of a method according to the invention in such a manner that before the web is cut off, glue is spread between the core and the web from above the core, the web being pressed against the core so that it adheres to it and the web being cut off only after it has adhered to the core. Correspondingly, the method can be carried out by means of an arrangement according to the invention which is characterized in that the fastening means comprise a glue spreading device mounted in the core chute in such a manner that after the core chute has been turned above the support rolls the glue spreading device is positioned between the web and the core above the core, the glue spreading device being arranged to spread glue between the core and the web before the web is cut off.

Essential in the method of the invention is that the web is fastened to the core after it has been displaced on to the support rolls but before the web is cut off by spreading glue between the web and the core, more precisely, into a gap defined between the web emerging from between the support rolls and the core making contact with the web, so that the glue is spread only within the required fastening area, and does not contaminate the surroundings. Thereafter the web is pressed against the core and cut off between the core and the finished web reel.

Essential in the arrangement of the invention is that the gluing device, preferably formed by glue spreading nozzles, is mounted within the core chute, whereby the glue can be spread between the core and the web while the core is being transferred on the core chute on to the support rolls. An advantage of the invention is that the gluing step takes less time than prior art solutions in addition to which it is reliable in operation and simple to realize and does not contaminate the surroundings with glue.

The invention will be described in greater detail in the attached drawings, wherein FIG. 1 shows a reeling device at an operational stage when the reeling has been completed;

FIG. 2 shows an operational stage when a new core has been displaced on to the support rolls and glue is being spread on the web and the core;

FIG. 4 shows the cutting off of the web before the initiation of the reeling of a new reel.

Figure 1:
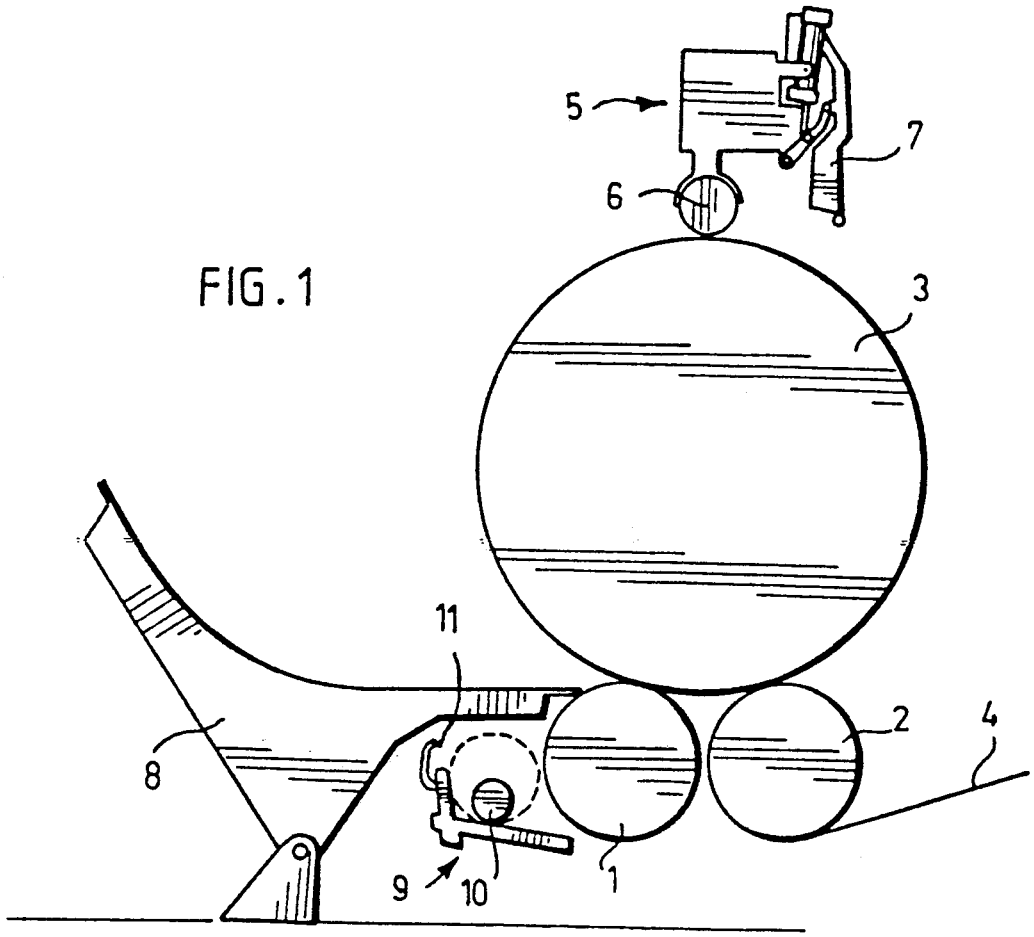

FIG. 1 shows a reeling device comprising support rolls 1 and 2 on which a reel 3 is reeled to a desired size. A web 4 is passed on the reel 3 from under the support roll 2 and from between the support rolls 1 and 2. The device further comprises a pressing and cutting device 5 with a support roll 6 and a cutting member 5. A lowering bucket 8 is provided for lowering a finished reel 3 down from the reeling device, and a core chute 9 for placing a new reel 10 on the support rolls 1 and 2. The reel chute 9 further comprises a gluing device 11 for gluing the web 4 to a core 10.

Figure 3:
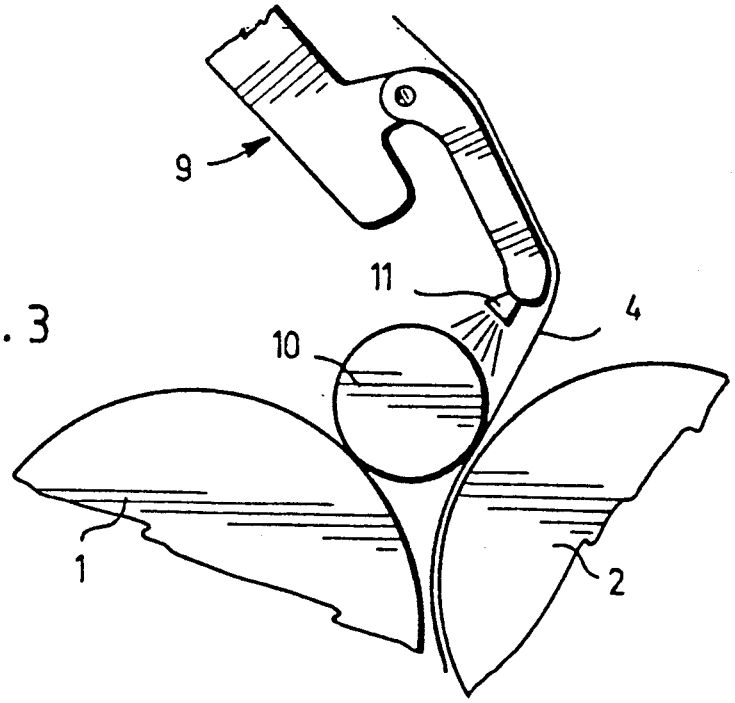
FIG. 3 is a more detailed view of the spreading of glue and the position of the gluing device at the operational stage of FIG. 2.

In FIG. 1, the reel 3 has achieved a desired size and the reeling has been interrupted. The pressing and cutting device 5 is then lifted off the reel 3 and the reel is transferred in a manner known per se on to the lowering bucket 8, which is turned to the left in the figure so that the core chute 9 with a new core 10 can be turned from between the lowering bucket 8 and the support roll 1 above the support roll 1 so that the core 10 falls into a gap between the support rolls 1 and 2 as shown in FIG. 2. At the same time the core chute 9 is turned above the support rolls 1 and 2 so that it pushes the web 4 emerging from between the support rolls 1 and 2 off the core 10 and is positioned between the web 4 and the core 10, whereby only the lower portion of the core 10 comes into contact with the web 4 and a slit tapering towards the support roll 2 is defined between the core 10 and the web 4. At this stage, the gluing device 11 applies glue between the core 10 and the web 4. The glue preferably spreads in both directions so that the web 4 will later adhere properly to the core 10. FIG. 3 is a more detailed view of the position of the core chute 9 relative to the web 4, the core 10 and the support rolls 1 and 2 during the spreading of glue.

At the following stage, shown in FIG. 4, the core chute 9 is withdrawn from the gluing position and the pressing and cutting device 5 is lowered down for cutting off the web 4. The core chute 9 supports the web at a distance from the core 10 while the pressing and cutting device 5 is lowered in a manner known per se on the core 10 to press the web 4 against the core 10 while the cutting edge of the cutting member 7 cuts off the web 4 beside the core 10 between it and the reel 3. Thereafter the reel 3 is lowered down by means of the lowering bucket 8, the core chute 9 is turned back to the waiting position, the cutting member 7 is lifted off the core 10 and the pressing and cutting device 5 is lowered sufficiently down for the support roll 6 to be able to press the core 10 against the support rolls 1 and 2. Then the reeling of a new reel can begin.

An advantage of the solution of the invention is that by spraying the glue in the narrow space between the core 10 and the web 4, it can be ensured that the glue will be spread as desired to achieve proper adherence and without spreading the glue into the surroundings, thus avoiding the contamination of the apparatus. The apparatus is simple to manufacture, easy to use and very reliable in operation.

What is claimed is:

1. A method of fastening a web (4) to a core (10) in a reeling device, comprising transferring a reeled web reel (3) from support rolls (1, 2) into a lowering bucket (8); transferring a new core (10) in a core chute (9) on to the support rolls (1, 2) from between the lowering bucket (8) and the support rolls (1, 2) before the web (4) is cut off between the reeled web reel (3) and a new reel to be reeled, the web (4) between the reeled web reel (3) and the support rolls (1, 2) passing above the core (10); cutting off the web (4) between the core (10) and the reeled web reel (3); and fastening the web to the core (10), characterized in that before the web is cut off, glue is spread between the core (10) and the web (4) from above the core (10), the web (4) being pressed against the core (10) so that it adheres to it and the web (4) being cut off only after it has adhered to the core (10).

2. A method according to claim 1, characterized in that the glue is spread between the core (10) and the web (4) substantially immediately after the core (10) has been transferred on to the support rolls (1, 2), the glue being spread by means of a glue spreading device (11) secured in the core chute (9).

3. An apparatus for fastening a web (4) to a core (10) comprising two support rolls (1, 2) on which the web (4) is reeled on to the core (10); a lowering bucket (8) on which a reeled web reel (3) is transferred; a core chute (9) on which a new core (10) is displaced on to the support rolls (1, 2) by turning the core chute (9) from between the support rolls (1, 2) and the lowering bucket (8) above the support rolls (1, 2) so that the core (10) falls into a gap between the support rolls (1, 2); a cutting device (7) for cutting a web (4); anu fastening means (11) for fastening the web (4) to the core (10), wherein the fastening means comprise a glue spreading device (11) mounted in the core chute (9) in such a manner that after the core chute (9) has been turned above the support rolls (1, 2) the glue spreading device is positioned between the web (4) and the core (10) above the core (10), the glue spreading device (11) being arranged to spread glue between the core (10) and the web (4) before the web (4) is cut off.

4. An apparatus according to claim 3, wherein the glue spreading device comprises glue nozzles from which glue is spread between the core (10) and the web (4).

* * * * *